United States Patent [19]

Pendleton et al.

[11] Patent Number: 4,765,177

[45] Date of Patent: Aug. 23, 1988

[54] GROMMET FORMING FIXTURE

[75] Inventors: Richard A. Pendleton, Brockton; Richard C. Jernstedt, Humarock; Clarke R. Sutherland, East Bridgewater, all of Mass.

[73] Assignee: PCI Group, Inc., New Bedford, Mass.

[21] Appl. No.: 925,455

[22] Filed: Oct. 31, 1986

Related U.S. Application Data

[63] Continuation of Ser. No. 783,138, Oct. 2, 1985, abandoned.

[51] Int. Cl.[4] ..... B21D 37/00

[52] U.S. Cl. ..... 72/412; 72/391; 29/512; 227/15; 227/19; 227/20; 227/34; 227/143; 227/155

[58] Field of Search ..... 227/15, 19, 20, 33, 227/34, 55, 54, 154, 155, 143, 144; 29/243.53, 512, 522, 523; 72/412, 391

[56] References Cited

U.S. PATENT DOCUMENTS

| | | | |
|---|---|---|---|
| 481,587 | 8/1892 | Platt | 227/155 |
| 2,717,714 | 9/1955 | Haley | 227/15 |
| 3,144,157 | 8/1964 | Dritz | 227/55 |
| 3,376,727 | 4/1968 | Hinden | 72/391 |
| 3,515,419 | 6/1970 | Baugh . | |
| 3,726,553 | 4/1973 | Reynolds et al. . | |
| 3,890,695 | 6/1975 | Gaastra . | |
| 3,984,041 | 10/1976 | Le Page | 227/144 |

FOREIGN PATENT DOCUMENTS

| | | | |
|---|---|---|---|
| 2822051 | 11/1979 | Fed. Rep. of Germany | 29/243.52 |
| 1213286 | 11/1970 | United Kingdom . | |

*Primary Examiner*—David Jones
*Attorney, Agent, or Firm*—Donald N. Halgren

[57] ABSTRACT

A fixture for use with a pull tool to form the parts of a grommet about an opening in material to reinforce the material opening.

1 Claim, 3 Drawing Sheets

GROMMET FORMING FIXTURE

This is a continuation of co-pending application Ser. No. 783,138 filed on Oct. 2, 1985 now abandoned.

BACKGROUND OF THE INVENTION

1. Field of the Invention

This invention relates to a fixture for forming a grommet by means of a pull tool.

2. Summary of the Prior Art

In the art of using grommets for reinforcing openings in boat tarps, canvas, etc., it has been customary to supply the grommets with an anvil shaped to the grommet size that could be struck with a hammer to set and form the grommet about a material opening. This requires the user in quite often a difficult environment to handle a multiplicity of forming tools along with the grommet parts themselves in order to accomplish reinforcing the material opening with the formed grommet.

It, therefore, has been found desirable to utilize the pull force of a setting tool, such as a conventional blind rivet tool, along with a grommet setting fixture to facilitate forming the grommet about a material opening.

SUMMARY OF THE INVENTION

It is an object of this invention to use a pull tool along with a fixture to set a grommet about an opening in a material to reinforce the material opening.

It is also an object of this invention to provide a fixture having upper and lower dies with a stem attached to the lower die and extending through the upper die. With the stem inserted into a pull tool, the dies can be forced together to form the parts of a grommet positioned therebetween.

It is a further object of this invention to provide the upper and lower dies of a grommet setting fixture with a contour mating with the grommet contour to guide the grommet members together while forming the grommet.

It is an additional object of this invention to provide an upper die of a grommet setting fixture with a head adapted to be threaded into the pull housing of a pulling tool. A lower die has a pull stem passing through the upper die. With the pull stem positioned in the pull tool, the stem can be pulled forcing the dies together to set the grommet therebetween.

It is still a further object of this invention to provide a two part die for forming a grommet wherein one of the dies has a plurality of surfaces contoured to the shape of a plurality of different sized grommet members so that different sized grommets can be formed from a single die.

DESCRIPTION OF THE PREFERRED EMBODIMENT

Figure 1:
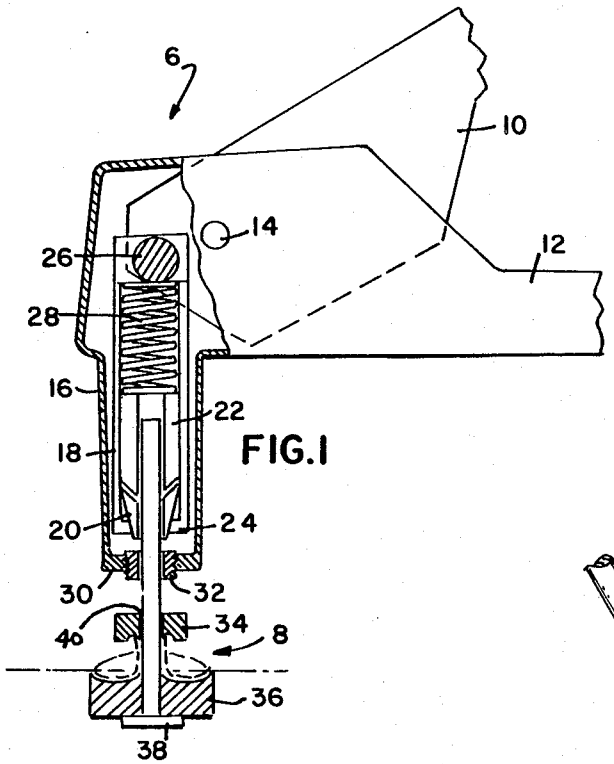
FIG. 1 diagrammatically illustrates the grommet forming fixture in combination with a conventional blind rivet setting tool that can be used to force the dies of the fixture together to form a grommet.

Attention is directed to FIG. 1 which illustrates a conventional pull tool 6 which is adapted to set blind rivets. The pulling action is utilized on the grommet forming fixture 8 to form a grommet about an opening in a material to reinforce the material opening. It will be appreciated that other types of pull tools could be utilized with the fixture of this invention, this particular tool being illustated to demonstrate the operation of the fixture. It should also be appreciated that other fasteners, such as eyelets, could also be formed with a properly contoured fixture and a pull tool.

The tool 6 comprises a pair of handles 10, 12 pivoted together at 14. The handle 12 has a tubular pull housing 16 containing a mandrel pulling mechanism 18. This mechanism generally comprises a pair of jaws 20 and a spring biased jaw pusher 22 enclosed in a jaw puller 24 which is pivoted to cross pin 26 carried in handle 10. The spring 28 acts between the pin 26 and the jaw pusher 22 to bias the jaws 20 to an open condition. The stem of a mandrel of a blind rivet assembly (not shown) is adapted to be inserted into the jaws 20. By separating the handles 10, 12, the spring 28 forces the jaw pusher 22 against the jaws 20 to open the jaws for receipt of the mandrel stem (not shown). As the handles 10, 12 are pivoted closed, the jaw puller 24 will force the jaws 20 closed. The end 30 of the tubular pull housing 16 has a nose piece 32 and the flange of a rivet would abut the nose piece 32 and upon further pivoting handles 10, 12 closed, the jaws 20 will grip the mandrel stem and jaw puller 24 will move upwardly to pull the stem to upset the rivet body. This is a conventional manner of operation of a pull tool of this type which is further illustrated in U.S. Pat. No. 3,324,700.

Figure 2:
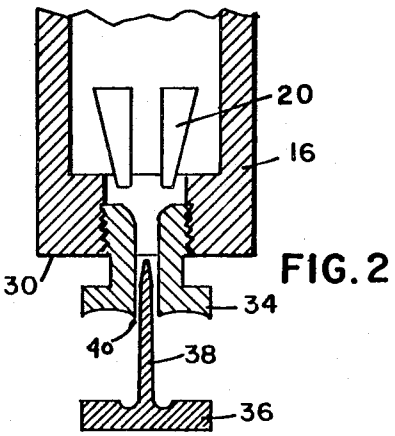
FIG. 2 diagrammatically illustrates the form of the fixture wherein the upper die of the fixture is threaded into the pull housing of a pull tool.

The grommet forming fixture 8, as diagrammatically illustrated in FIGS. 1 and 2, comprises an upper die 34 and a lower die 36. A pull stem 38 on lower die 36 is adapted to passes through the opening 40 in the upper die 34 and be received into the jaws 20 of the pull tool 6. The upper die 34 and lower die 36 are contoured to receive the upper and lower parts 42, 44 of a grommet 46. With the pull stem 38 inserted into the nose piece 32, as the pull tool 6 is operated, the pull stem 38 will be gripped by jaws 20 and pulled, forcing the dies 34, 36 together to form the grommet 46, as will become apparent hereinafter. In the form of the fixture 8 illustrated in FIG. 1, the upper die 34 acts against the nose piece 32 of the pull tool 6. In the form of the fixture illustrated in FIG. 2, the upper die 34 is threaded into the pull housing 16 of the pull tool 6.

Figure 3A:
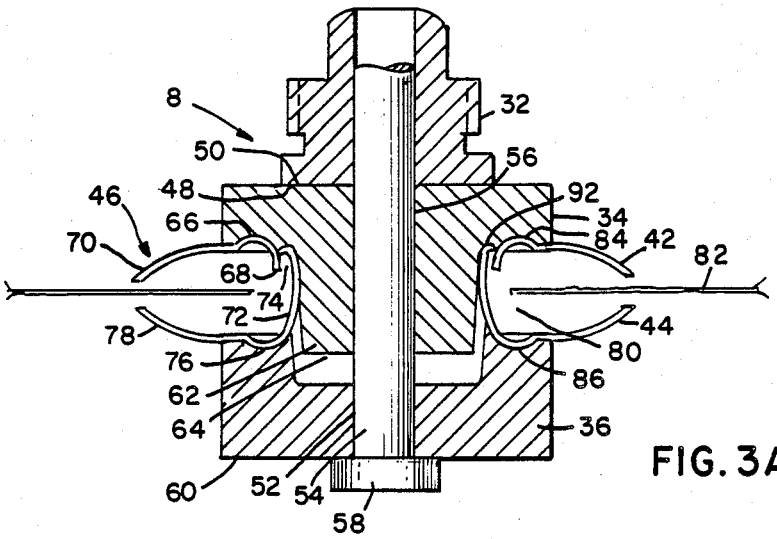
FIGS. 3A and 3B are illustrations of the fixture of FIG. 1 in the position prior to forming and after forming the grommet, respectively.
Figure 3B:
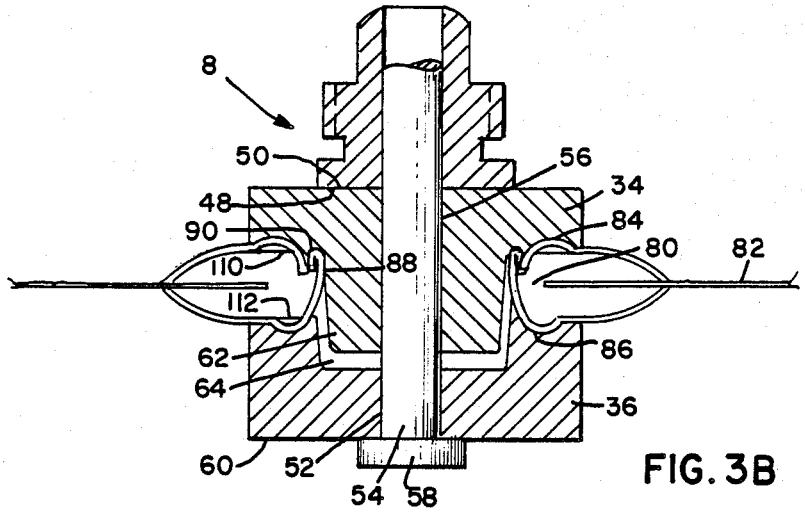

Attention is now directed to FIGS. 1, 3A and 3B which illustrate one form of the fixture wherein the upper die 34 has a flat surface 48 adapted to rest against the surface 50 of nose piece 32. The lower die 36 has an opening 52 receiving the stem 54 which passes through the opening 56 in upper die 34. The openings 52 and 56 are proximate to the diameter of stem 54 to main the dies 34, 36 in alignment. The stem has a head 58 resting against the surface 60 of lower die 36.

The die 34 has a truncated cone shaped body portion 62 which is received in the cylindrical recess 64 of the cup shaped lower die 36. The grommet parts 42, 44 are of conventional configuration with the upper part 42 having an inner circular shoulder 66 surrounding opening 68, the shoulder 66 extending outwardly to a circular dish shaped flange 70. The lower part 44 of grommet 46 has an inner tubular portion 72 around an opening 74. The tubular portion 72 has an inner circular shoulder 76 merging into the outwardly extending dish shaped flange 78. The grommet parts 42, 44 are adapted to be inserted into an opening 80 of a material 82 with the material extending between the flanges 70 and 78 of the grommet parts 42, 44.

The upper die 34 has an annular recess 84 seating the circular shoulder 66 of the grommet upper part 42. The lower die 36 has an annular recess 86 seating the circular shoulder 76 of the grommet part 44. In this fashion, the grommet parts 42, 44 are seated into the upper and lower dies 34, 36, respectively, with the body portion 62 of upper die 34 received in tubular portion 72 of lower grommet part 44. Also, the inner end 88 of the truncated shaped body portion 62 of upper die 34 has an annular recess 90 adapted to receive the end 92 of the tubular portion 72 of the lower grommet part 44. The body portion 62 of die 34 guides the tubular portion 72 of grommet part 44 so that the end 92 of tubular portion 72 is guided into recess 90 so that the end 92 of tubular portion 72 is folded during forming of the grommet.

In the formation of the grommet, as illustrated in FIGS. 3A and 3B, the grommet parts 42, 44 are positioned into the opening 80 of material 82 so that the material extends between the flanges 70 and 78 of grommet parts 42, 44. The pull stem 38 is inserted through the lower and upper dies, and the tubular portion 72 of grommet part 44 will ride up the surface of the body portion 62 of upper die 34 and into the opening 68 of grommet part 42 to align the grommet parts and seat the shoulders 66, 76 of the grommet parts into their respective recesses 84, 86 of the upper and lower dies. The pull stem 38 is then inserted into the nose piece 32 to be gripped by the jaws 20 of the pull tool 6. As the pull tool is operated to force the dies together, the end 92 of the tubular portion 72 of grommet part 44 will be received into recess 90 of upper die 34. As the dies are closed, the recess 90 guides the end 92 of tubular portion 72 around to fold over the opening 68 in the upper grommet part 42 and against the shoulder 66 to lock the grommet in assembled form around the material (See FIG. 4). It should be appreciated the pull stem 38 could be a nail of proper diameter for use with the dies so that the parts of the grommet setting fixture supplied with the grommets in a package for the handyman user would only be the upper and lower dies.

Figure 4A:
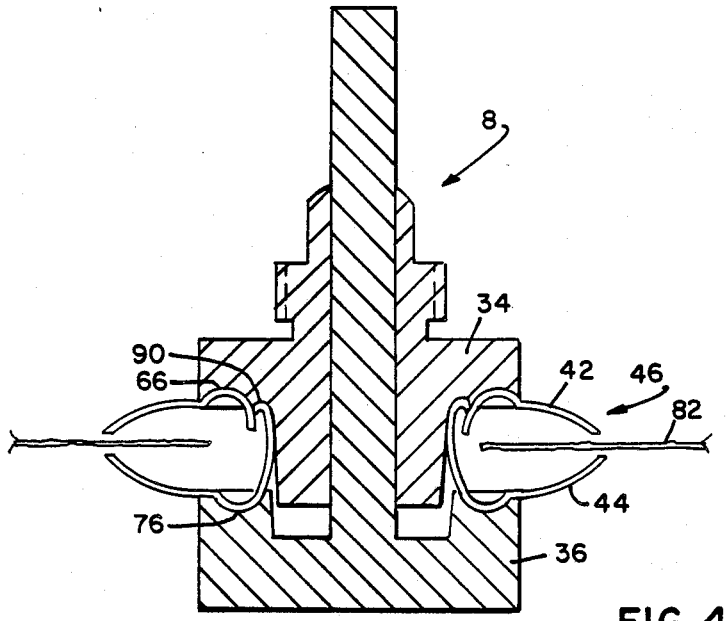
FIGS. 4A and 4B are illustrations of the fixture of FIG. 2 in the position prior to forming and after forming the grommet, respectively.
Figure 4B:
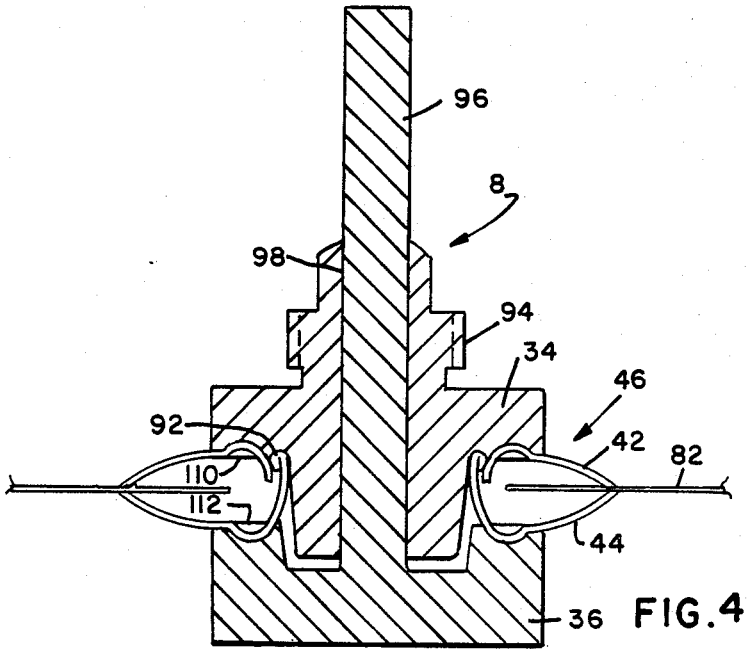

Attention is now directed to FIGS. 2, 4A and 4B which illustrate the embodiment wherein the upper die 34 is integral with the threaded insert 94 which is adapted to be secured into the pull housing 16. The lower die 36 has an integral pull stem 96 adapted to be received in the opening 98 of the upper die 34. The grommet parts are positioned in dies in the same fashion as described in connection with the fixture embodiment of FIGS. 1 and 3A and 3B and the dies have the same contour matching the contour of the grommet parts to form the grommet about the material to reinforce the opening in the material.

Figure 5:
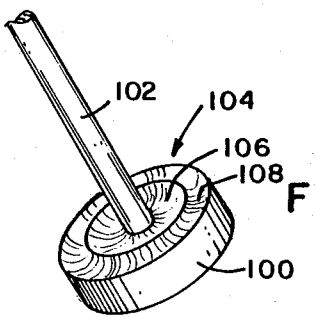
FIG. 5 is an illustration of how a single die of the fixture can be contoured to form a plurality of different sized grommets.

Attention is now directed to FIG. 5 which illustrates a lower die 100 having an integral pull stem 102. In this configuration, the lower die working surface 104 has a plurality of disk shaped recesses 106, 108 each of which can receive the appropriate size grommet part so that a single lower die 100 can be used to form more than one size grommet when used with the proper sized upper die.

It can thus be seen that with the use of upper and lower dies 34, 36 with working surfaces 110, 112, respectively, cooperating with the contour of the grommet parts, and by having a pull stem passing through the dies and operative with a pull tool, a grommet can be easily formed by the pull tool.

It should also be appreciated that with either one or both of the dies 34, 36, properly contoured, other fasteners such as eyelets could also be formed about a material opening to reinforce the opening.

We claim:

1. A fixture adapted to be used with a pull tool to form the parts of a fastener about an opening in material to reinforce the material opening, the fastener being a grommet having an upper part with an annular shoulder about an opening and a lower part with an annular shoulder and a tubular portion comprising:

(a) an upper die having a die having a truncated lower portion and a central opening and a threaded upper portion adapted to be positioned in the pull tool;

(b) a lower die having a truncated opening for guidingly receiving said truncated lower portion and a pull stem associated therewith, said pull stem adapted to be inserted through the fastener and said opening in said upper die and into the pull tool;

(c) said upper and lower dies each having a working surface contoured to the fastener so that upon the pull tool pulling said pull stem, said dies force the fastener about the material opening;

(d) said upper die working surface having a first outer annular recess for receiving the annular shoulder of the upper grommet part and a second inner annular recess for receiving the tubular portion of the lower grommet part, said truncated lower portion providing means to guide one part of the fastener into another part of the fastener, said second inner recess providing means to fold the tubular portion of the lower grommet part about the opening in the upper grommet part; and, (e) said lower die working surface having a plurality of annular recesses whereby a single lower die can be used to form more than one size grommet.

* * * * *